United States Patent [19]

Servin et al.

[11] 4,072,042

[45] Feb. 7, 1978

[54] AUTOMATIC METAL PULLER

[75] Inventors: Arturo Servin; Jose Servin, both of Los Angeles, Calif.

[73] Assignees: Roger D. Camp; Mattias J. Randall-Ford, ; part interest to each

[21] Appl. No.: 654,805

[22] Filed: Apr. 12, 1976

[51] Int. Cl.[2] ..... B21D 1/12; B25D 17/00; B25B 19/00

[52] U.S. Cl. ..... 72/457; 72/705; 81/52.3; 173/29; 173/104

[58] Field of Search ..... 72/705, 457; 81/52.3, 81/52.35; 173/29, 46, 104; 29/275

[56] References Cited

U.S. PATENT DOCUMENTS

| | | | |
|---|---|---|---|
| 1,871,732 | 8/1932 | Olmstead | 173/29 |
| 2,934,984 | 5/1960 | Woodman | 72/705 X |
| 3,030,837 | 4/1962 | Chartier | 72/705 X |
| 3,478,567 | 11/1969 | Galutia | 72/457 |
| 3,635,072 | 1/1972 | Steinmann | 72/705 X |

*Primary Examiner*—C.W. Lanham
*Assistant Examiner*—D. M. Gurley

[57] ABSTRACT

An improvement to a conventional slap-hammer which allows the hammer to be rotated by a pneumatic wrench or like device. A universal joint is attached to the top of the slap hammer to enable the latter to be rotated by the output shaft of a pneumatic wrench. The housing of the wrench is held by a closable harness that encircles the housing when closed and thereby prevents the output shaft from becoming disengaged from the universal joint.

2 Claims, 3 Drawing Figures

AUTOMATIC METAL PULLER

BACKGROUND OF THE INVENTION

A slap-hammer is a device that is used primarily in auto body shops to help repair dented body panels and the like. This type of hammer has an elongated body with a self tapping screw at the bottom. A heavy weight slides freely on the body between a lower stop and an upper stop, the former being above the screw and the latter being usually at the top of the device.

When a panel dent is to be "pulled out," a small hole is drilled into the panel in the deepest portion of the dent. The screw is introduced into the hole and the body is rotated, allowing the screw threads to get a firm purchase on the panel. Then, the weight is gently pushed to the lower stop. It is then grasped firmly and pulled rapidly towards the upper stop. The momentum acquired by the weight in travelling is transferred to the upper stop upon collision, allowing a large force to be excited on the panel to pull the dent out.

Frequently, dents are so large that this operation must be repeated. In practice, this can be rather time consuming, because it takes time to rotate the hammer enough so that the user is sure that the screw has a firm purchase on the body panel. After this rotation has been accomplished, the rest of the operation goes relatively quickly.

SUMMARY OF THE INVENTION

This invention is an improvement to a conventional slap-hammer. With this invention, a pneumatic air wrench or similar device can be used to rotate the hammer, so as to cut down the length of the most time-consuming portion of the operation of the tool.

DETAILED DESCRIPTION OF THE PREFERRED EMBODIMENT

Figure 1:
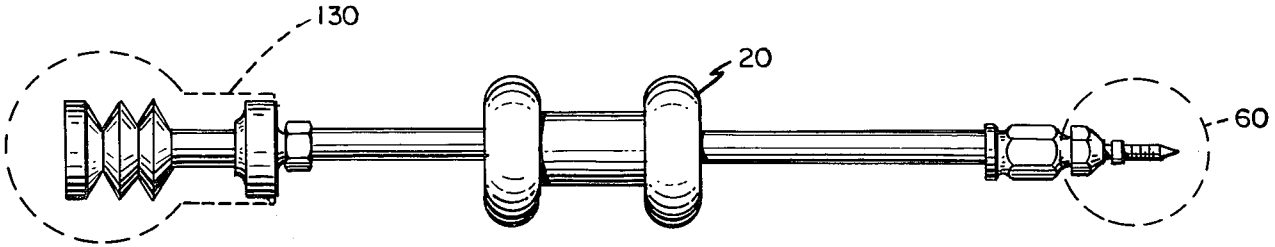
FIG. 1 shows the invention minus the harness.
Figure 2:
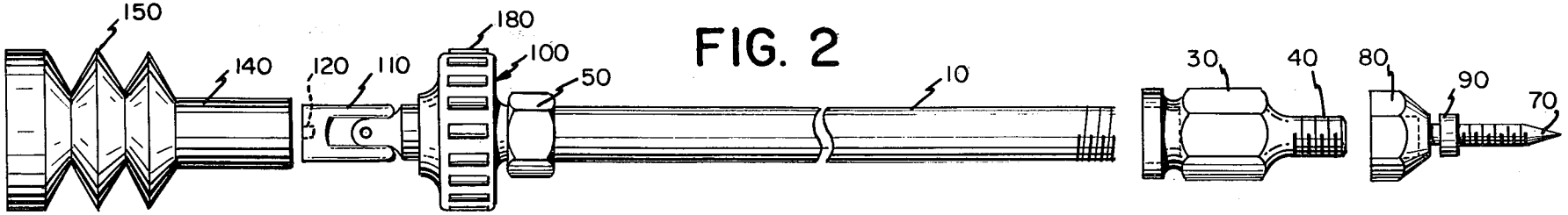
FIG. 2 is an exploded view of the top and bottom ends of the invention, minus the harness.

An elongated solid rod 10 is threaded at both ends. Freely slidable along the length of the rod and mounted thereon is a weight 20 that is shaped like a dumbbell with an axial base through which the rod can extend. Threaded onto the bottom of the rod is a lower stop 30, with a threaded projection 40 extending downwardly from the stop 30. A nut 50, threaded on the upper end of the rod, forms an upper stop.

A bit, generally indicated by 60 in FIG. 1, is threaded onto projection 40. The bit has an elongated punch 70 extending downwardly, the punch having a sharply pointed lower end and being threaded with self-tapping threads, to the top end of the punch is attached a punch holder 80. Both the holder 80 and the lower stop have solid bodies with hexagonal exteriors to allow them to be tightened together or separated by wrenches. Threading stop 90 is a disc mounted on the punch between the threaded portion and the holder 80.

A roller bearing race 100 is threaded on the shaft just on top of the upper stop. Directly above the race, and attached to the top end of the shaft, is a universal joint 110 of sort conventionally used to drive socket wrenches. A cubical recess 120 in the top of the joint can receive the output shaft of a pneumatic wrench or like tool.

A flexible boot has a hollow, cylindrical bottom portion 140 that skips over the joint 110. On top of this portion is a hollow, accordion-like portion 150 that can be compressed. It can be seen that snapping the output shaft of a pneumatic wrench into recess 120 with the boot in place will cause the entire joint to be covered, keeping out dust and metal grit and prolonging the life of the joint.

A hollow cylindrical collar 160, open at both ends, has a horizontal circular recess 170 inscribed on its interior face. The recess is so dimensioned that the race and bearings 180 in it can just fit inside. With this configuration, the race can rotate inside the collar but cannot move upwardly or downwardly inside it.

Figure 3:
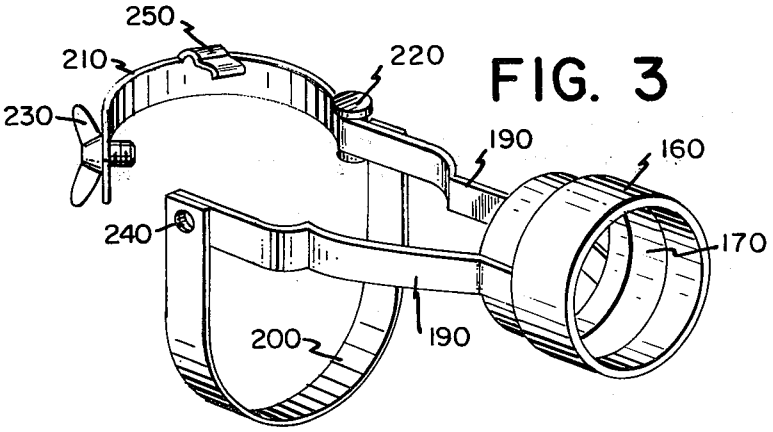
FIG. 3 shows the harness, for use in the invention.

A harness shown generally at 130 in FIG. 1 is formed by two opposed, vertically elongated strips 190 which extend upwardly from diametrically opposed points on the top of the collar. A horizontal U-shaped member 200 has each of its free ends attached to the top end of a corresponding strip. A semi-circular band 210 has one end attached to hinge 220, that is attached to the top end of one of the strips. The hinge, as can be seen in FIG. 3, allows the band to be rotated in the plane of the strips, perpendicular to member 200. The free end of the band holds a wingnut 230, that can engage a tapped hole 240 which is located near the top of the strip opposite the hinge. The hole extends through the member 200. When closed, the band faces concave down.

In use, the band is opened, and a pneumatic wrench is introduced into the harness. Since, in practice, the joint is located between the strips 190, closing the band keeps the output shaft of the wrench engaged with the joint. The weight is held with one hand, and the wrench is operated with the other hand. The punch is introduced into an appropriatedly drilled hole, and the wrench is operated until the stop 90 presses against the body panel dent that is to be pulled out. The weight is then gently pushed to stop 30, and then violently pulled back to stop 50, pulling out the dent. When the punch gets dull and/or worn, holder 80 can be unscrewed and a new bit fitted.

A clasp 250 is secured to the inside of band 210 at the midpoint and adjacent the top edge thereof. This clasp can be used to hold down the air wrench and prevent it from jumping out of the housing.

While the invention has been described with particular reference to the drawings, the protection sought is to be limited only by the terms of the claims which follow.

We claim:

1. A slap hammer designed for being driven by a pneumatic wrench and the like, comprising:

a conventional slap hammer with an elongated body having a self-tapping screw at the bottom;

a coupling detachably securing the top of the body to an output shaft of a pneumatic wrench whereby the wrench can rotate the body about its axis, said coupling including a universal joint for receiving the shaft and a flexible compressible hollow boot covering the joint when the shaft is secured to the joint;

a harness detachably securing the slap hammer to the housing of said wrench; and a race of roller bearings secured to said body below the coupling, said harness encircling the race in a manner at which the race and harness are kept from separating and the race is allowed to rotate within the harness.

2. The device of claim 1 wherein the harness comprises:

a hollow, cylindrical collar open at both ends and having a horizontal, circular retaining recess inscribed on its interior face, whereby the race can be introduced into the recess to permit the race to be rotated within the collar while preventing the race from moving upwardly or downwardly within the collar;

two vertically elongated strips extending upwardly from diametrically opposed points on the top of the collar; and a semi-circular band hingedly attached at one end to the top end of one of the strips and detachably securable to the top end of the other strip, the hinge allowing the band to be rotatable in the plane of the strips.

* * * * *